US005637952A

United States Patent [19]

Tischer

[11] Patent Number: 5,637,952

[45] Date of Patent: Jun. 10, 1997

[54] HIGH-CURRENT CATHODE FOR PICTURE TUBES INCLUDING A GRID 3-ELECTRODE HAVING A DIAPHRAGM WITH REDUCED APERTURES

[75] Inventor: Kurt-Manfred Tischer, Kirchheim unter Teck, Germany

[73] Assignee: Nokia Technology GmbH, Pforzheim, Germany

[21] Appl. No.: 572,311

[22] Filed: Dec. 14, 1995

Related U.S. Application Data

[63] Continuation-in-part of Ser. No. 229,915, Apr. 19, 1994, abandoned.

[30] Foreign Application Priority Data

Apr. 26, 1993 [DE] Germany ..... 43 13 576.5

[51] Int. Cl.[6] ..... H01J 29/50

[52] U.S. Cl. ..... 313/412; 313/414; 313/270

[58] Field of Search ..... 313/412, 414, 313/446, 447, 452, 306, 270, 449

[56] References Cited

U.S. PATENT DOCUMENTS

| | | | |
|---|---|---|---|
| 3,319,102 | 5/1967 | Johnson | 313/270 |
| 4,168,452 | 9/1979 | Christensen et al. | 313/449 |
| 4,297,612 | 10/1981 | Anezaki | 313/270 |
| 4,358,703 | 11/1982 | Bijma et al. | 313/460 |
| 4,629,933 | 12/1986 | Bijma et al. . | |
| 4,649,317 | 3/1987 | Opresko | 313/414 |
| 5,117,153 | 5/1992 | Do | 313/270 |

FOREIGN PATENT DOCUMENTS

| | | |
|---|---|---|
| 0158388 | 10/1985 | European Pat. Off. . |
| 167780 | 1/1986 | European Pat. Off. . |
| 3035970 | 11/1982 | Germany . |
| 3216039 | 11/1982 | Germany . |
| 3708686 | 10/1987 | Germany . |

*Primary Examiner*—Sandra L. O'Shea
*Assistant Examiner*—Vip Patel
*Attorney, Agent, or Firm*—Ware, Fressola, Van Der Sluys & Adolphson LLP

[57] ABSTRACT

An electron-beam gun system is provided having a cathode arrangement and a grid electrode. The cathode arrangement is a high-current cathode (22) having an emitting surface (23). The grid electrode includes a hat-shaped grid 1-electrode (24) located at a distance of 30 to 80 μm from the emitting surface (23) of the high-current cathode (22), which has a width in a range of 30 to 70 μm in a passing area (18.2) for electrons. The grid electrode includes a grid 2-electrode (15) that is at least 250 μm wide in a passing area (18) for the electrons, and includes a grid 3-electrode (14) having an inlet side that is 250 to 400 μm wide in a passing area (18.1) for the electrons.

6 Claims, 3 Drawing Sheets

HIGH-CURRENT CATHODE FOR PICTURE TUBES INCLUDING A GRID 3-ELECTRODE HAVING A DIAPHRAGM WITH REDUCED APERTURES

This is a continuation-in-part application, claiming benefit to patent application Ser. No. 08/229,915, filed Apr. 19, 1994, now abandoned.

TECHNICAL FIELD

The invention concerns the design and manufacture of electron-beam gun systems for picture recording and picture displaying devices.

BACKGROUND OF THE INVENTION

According to the state of the art, electron-beam gun systems for picture recording and picture displaying installations are designed so that the electrons emitted by a hot cathode to form an electron-beam, pass a series of electrodes before they strike the impact surface (e.g. the inside of a television picture tube). The hot cathodes, which are conventionally used for this purpose, have peak beam current densities of about 0.5 A/cm$^2$, for example for television picture tubes.

In addition to these hot cathodes, so-called high-current cathodes are known, such as are used to produce microwaves and have beam current densities up to 10 A/cm$^2$.

It is further known that increased beam current densities from cathode arrangements, for example in picture tube electron-beam gun systems, produce improved, that is sharper images. As shown in this connection by electronic-optic research performed by the applicant, when the above indicated cathodes, which in this application are called high-current cathodes, are to be used in television picture tubes, it is necessary to keep the distance between the emitting surface of the high-current cathode and the grid 1-electrode, as well as the passing area of the electrodes through the grid 1-electrode, small, if the grid 2-voltage is to be maintained in the range of 800 to 1000 Volts. Tests to maintain the indicated conditions, performed in this regard by the applicant, were not successful in the past, because high-current cathodes require operating temperatures of 1100° C. and such temperatures do not allow the grid 1-electrode to remain stable, because of its small width.

For that reason the invention had the task of presenting an electron-beam gun system which permits the use of high-current cathodes in picture displaying and picture recording installations. Since these high-current cathode-equipped beam gun systems are of particular interest for large-size picture tubes, and until now these tubes were only manufactured in small quantities, the invention had the further task of presenting a manufacturing process for electron-beam gun systems with high-current cathodes, which allows most of these beam systems to be used, without extensive conversion of the production lines that are used to manufacture electron-beam gun systems with conventional output hot cathodes.

SUMMARY OF THE INVENTION

The first task is fulfilled by an electron-beam gun system where the cathode arrangement is designed as a high-current cathode arrangement, where a hat-shaped grid 1-electrode is located at a distance of 30 to 80 μm from the emitting surface of the high-current cathode, which is 30 to 70 μm wide in the passing area of the electrons, where the grid 2-electrode is at least 250 μm wide in the passing area of the electrons, and where the inlet side of the grid 3-electrode is 250 to 400 μm wide in the passing area of the electrons.

If the emitting surface of the hot cathode only has a diameter of 0.5 to 1.5 mm, this small emitting surface minimizes the evaporation of cathode material, which has a positive effect on the prevention of breakdowns and thermal grid emissions.

The hat-shaped design of the passing area for the electrons of the grid 2-electrode ensures that even at high-current cathode operating temperatures of up to 1100° C., no shifting takes place in the very narrow passing area of the grid 1-electrode.

Predistortion of the electron beam can be achieved by making the passing area in the grid 2-electrode an astigmatic beam aperture, such as a quadripole.

If the inlet part of the grid 3-electrode is equipped with a diaphragm, all grid 3-components can be obtained from normal production, because by means of the diaphragm on the one hand, the required width of the inlet part, and on the other hand the reduced aperture diameter required in this area for the high-current cathode, which is smaller than the normal production inlet part, can easily be adjusted.

The production of electron-beam gun systems with high-current cathodes is especially cost-effective, if the process sequence comprises the following steps:

Step 1: Stamping the grid electrodes two to four and a grid 1-holder, and forming a grid 1/cathode arrangement;

Step 2: Producing the grid 3-electrode;

Step 3: Producing a unit formed of the grid 4-electrode, the grid 3-electrode formed in step 2, the grid 2-electrode and the grid 1-holder in production lines that are otherwise used to form electron-beam gun systems without a high-current cathode arrangement, where the units adjusted for so-called vitrified spikes are permanently connected by two strips of glass;

Step 4: Connecting the grid 1/cathode arrangement to the grid 1-holder.

This process particularly permits such systems to be produced in small quantities with the normal system production lines, without conversion. This is based on the fact that the grid 4-electrode and at least the components of the grid 3-electrode facing the grid 4-electrode, come from normal production. The system itself can be mounted on vitrified spikes. However, care must be taken that when the units are connected according to the process of the invention, a carrier or grid 1-holder is also vitrified, while the hat-shaped grid 1-electrode (=grid 1/cathode arrangement) is later inserted and connected in the opening, i.e. outside of the production line.

If the inlet side of the grid 3-electrode is equipped with a diaphragm, the process is further simplified, because the inlet side of the grid 3-electrode can also be taken from normal production.

BRIEF DESCRIPTION OF THE INVENTION

BEST MODE FOR CARRYING OUT THE INVENTION

The invention will now be explained in more detail by means of the three figures.

Figure 1:
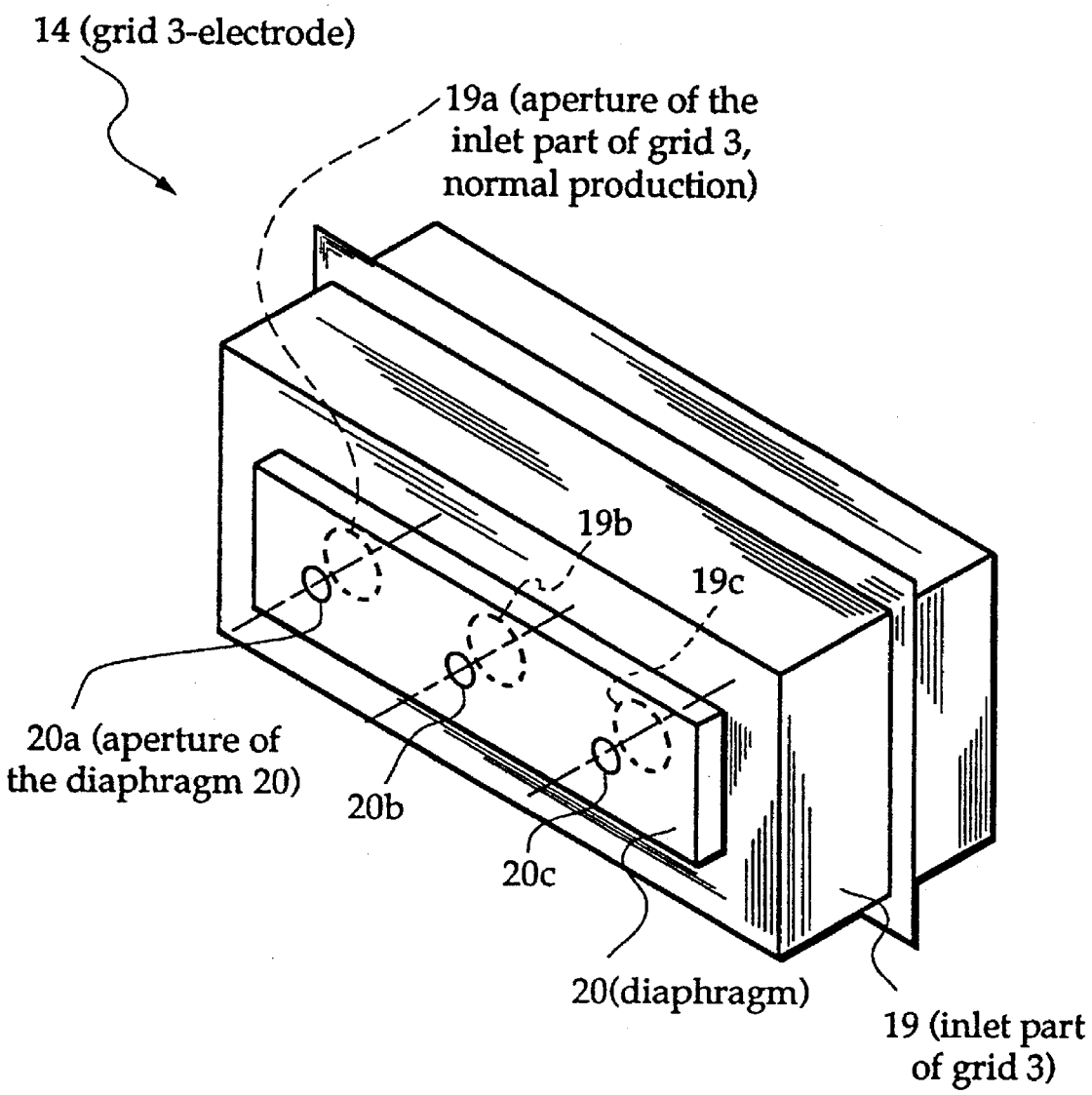
FIG. 1 shows a perspective view of a grid 3 electrode of the present invention used in a television picture tube.

FIG. 1 shows a perspective view of a grid 3-electrode 14 of the present invention which is used during normal production in a standard television picture tube with a low-current cathode. The grid 3-electrode 14 has an inlet part 19 with apertures 19*a*, 19*b*, 19*c*. The grid 3-electrode 14 also has a diaphragm 20 with apertures 20*a*, 20*b*, 20*c*, which is the focus of the present invention. As shown, the apertures 20*a*, 20*b*, 20*c* of the diaphragm 20 are smaller than the apertures 19*a*, 19*b*, 19*c* of the inlet part 19.

Figure 2:
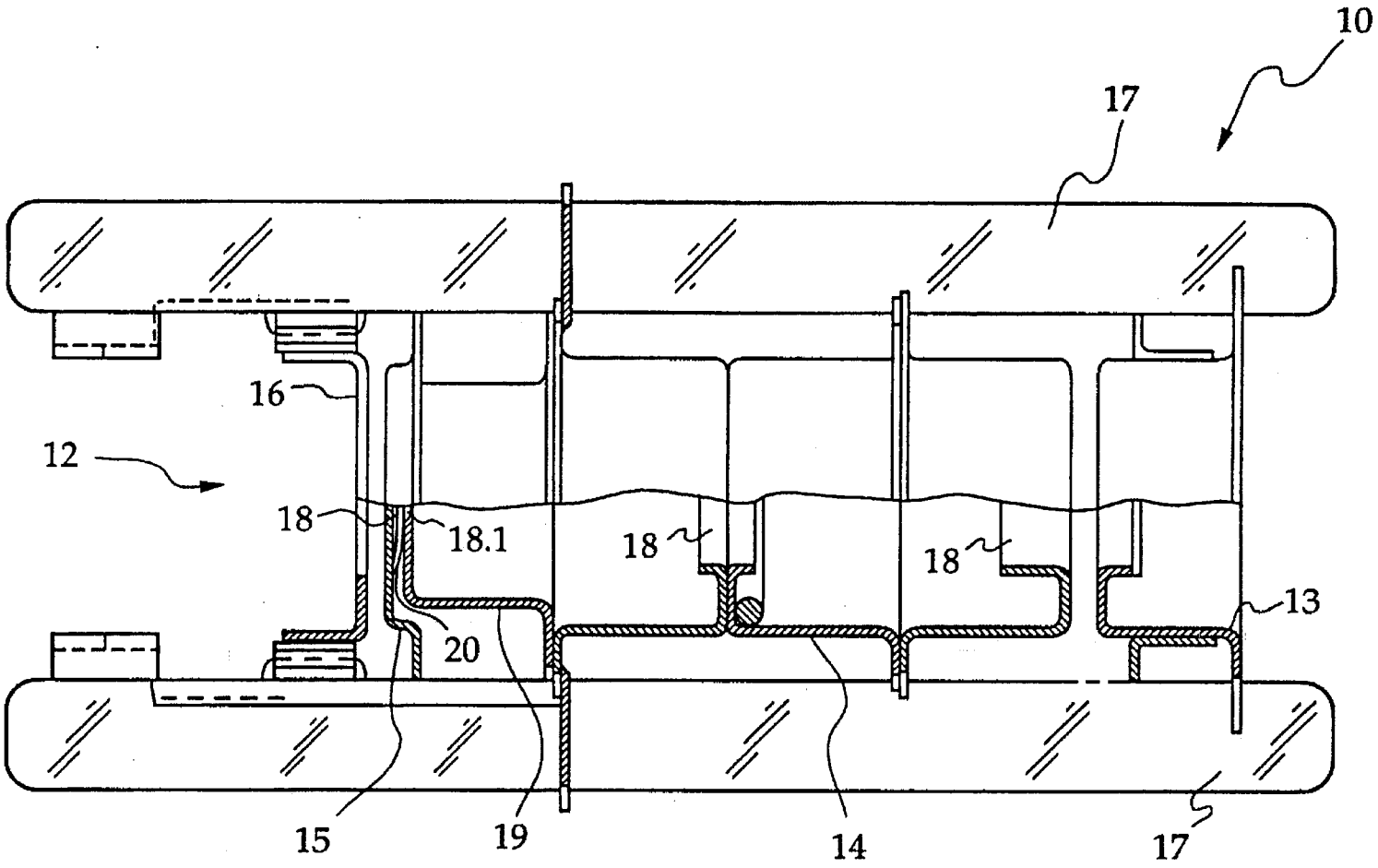
FIG. 2 is a section through an electron-beam gun system.
Figure 3:
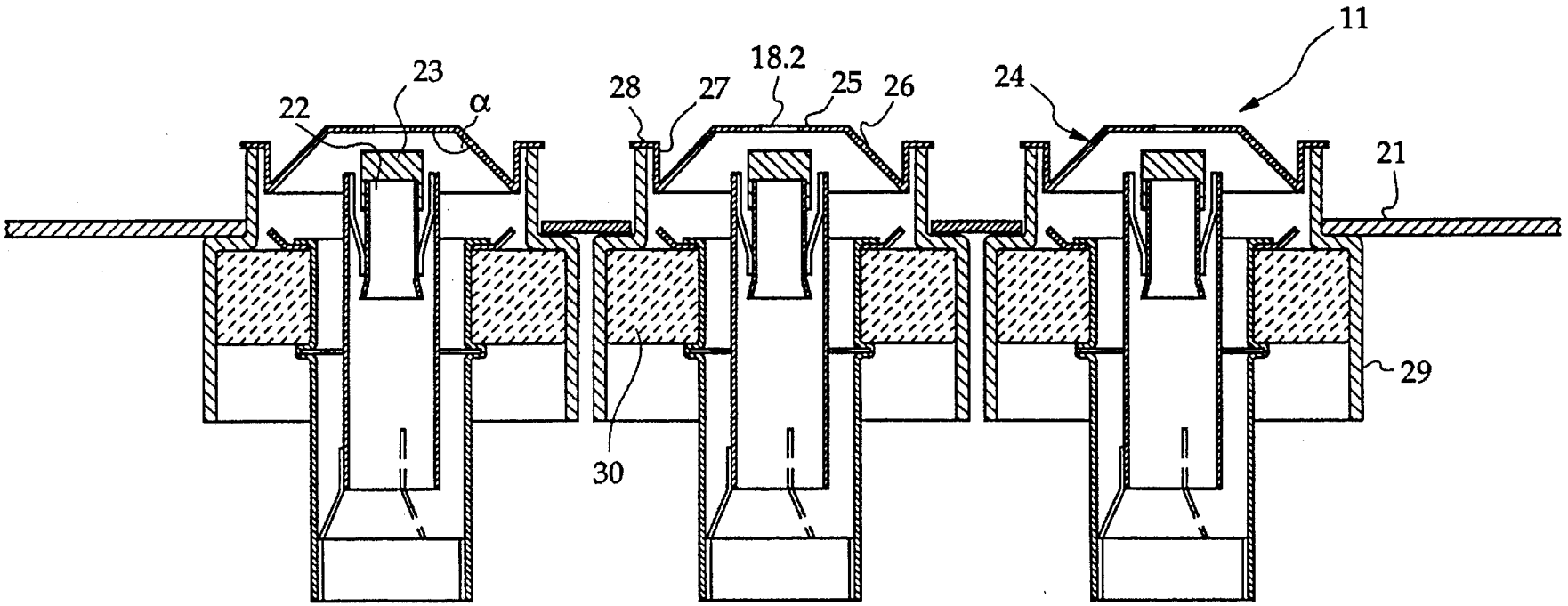
FIG. 3 is a section through a grid 1/cathode arrangement.

The arrangement shown in FIG. 2 is an electron-beam gun system 10 for television picture tubes, which is premounted, except for the grid 1/cathode arrangement 11 (see FIG. 3). This grid/cathode arrangement 11 is later placed in the location indicated by 12. The electron-beam gun system 10 shown in FIG. 1 consists of a grid 4-electrode 13 that faces the screen (not illustrated), the grid 3-electrode 14 connected to the grid 4-electrode 13, which consists of several components, and the subsequent grid 2-electrode 15. In addition, a grid 1-holder 16 is located between the location 12 and the grid 2-electrode 15. All these units 13, 14, 15 and 16 are located at a predetermined distance from each other, and are connected by two glass strips 17. All grid-electrodes 13 to 15 are pot-shaped and have passage holes 18 for the electron beam in the bottom. These passage holes 18 are visible on the right side of the configuration in FIG. 2. As a matter of completeness it should be pointed out that several of the arrangements shown in FIG. 2 can be combined to form the electron beam system 10 for television. In another not illustrated electron-beam gun system for color television, the grid electrodes 13, 14, 15, 24 can be designed so that three adjacent passage holes 18; 18.1; 18.2 are located in the pot bottom, and each grid electrode 13, 14, 15, 24 forms the common electrode for three different electron beams.

As is clearly visible in FIG. 2, the inlet part 19 of the grid 3-electrode 14 is equipped with a diaphragm 20 on the side facing away from the grid 4-electrode 13. This diaphragm 20 has the advantage that all the components of the grid 4-electrode 13 and grid 3-electrode 13 can be taken from the production of electron-beam gun systems 10 without high-current cathodes (that is, normal production) to manufacture a high-current cathode electron-beam gun system, and by means of the diaphragm 20, the diameter of passage hole 18.1 can be reduced with respect to the inlet part 19 of the normal production grid 3-electrode, and the pot bottom thickness increased. The latter is particularly interesting, because the mass production of electron-beam gun systems 10 with high-current cathode arrangements 22 does not appear to be economical at present.

However, the use of the diaphragm 20 in FIG. 2 does not mean that the inlet part 19 of the grid 3-electrode 14 must necessarily be equipped with the diaphragm 20. Rather, without considering the economical aspects, the inlet part 19 of another, not illustrated configuration example, can be produced with the same dimensions of the inlet part 19 of a grid 3-electrode 14 after it has been connected to the diaphragm 20.

Another advantage in connection with the use of the grid components 13, 14 taken from normal production, is that most of the assembly of electron-beam gun systems 10 for high-current cathode arrangements 22 can take place on the production lines used for the assembly of normal systems. To that effect, the components of the grid 4-electrode 13, the grid 3-electrode 14, the grid 2-electrode 15 and the grid 1-holder 16 are adjusted with respect to each other on so-called glass spikes, before glass rods 17 are introduced from the side to provide a permanent connection of the above mentioned components.

After the components of the arrangement in FIG. 2 are assembled, the grid 1/cathode arrangement 11 is inserted into the grid 1-holder 16 and connected thereto. FIG. 3 illustrates in more detail the design of the grid 1/cathode arrangement 11. Three grid 1/cathode arrangements 11 are inserted into one holding element 21 in the configuration example of FIG. 3. The significant components of each grid 1/cathode arrangement 11 are respectively the high-current cathode 22, which in the depicted configuration example has a beam current density of 5 A/cm$^2$ at an operating temperature of 1100° C., and the grid 1-electrode 24, located at a short distance from the emitting surface 23 (40 μm in this instance). In the depicted configuration example, the width of grid 1-electrode 24 in the passage area 18.2 is also 40 μm. To ensure sufficient thermal stability of this extraordinarily thin grid 1-electrode 24, and to control the operating temperatures of up to 1100° C. in the area of the grid 1-electrode 24, a cladding surface 26 is placed adjacent to the area 25, which is parallel to the emitting surface 23 and the passage hole 18.2. This cladding surface 26 forms an angle α of 135° with the side of the area 25 that faces the emitting surface 23. An edge piece 27 is placed against the free end of the cladding surface 26, and forms a 90° angle with respect to area 25. The flange 28 placed against the edge piece 27 inserts and connects the grid 1-electrode 24 to a tubular piece 29. The high-current cathode 22 is inserted into the tubular piece 29 and connected to the internal sheath of the tubular piece 29 by a ceramic disk 30.

The diameter of the emitting surface 23 of the high-current cathode 22 is 0.75 mm. This prevents any evaporated cathode material from shorting out the grid electrodes.

A recess is formed on the external sheath of tubular piece 29, whereby each of the three depicted grid 1-cathode arrangements 11 are inserted and connected to openings of holding element 21.

In another, not illustrated configuration example, the grid 1-electrode can be stamped in characteristic single- piece hat-shaped form, for example for three in-line cathodes 22. Nor is it necessary for each high-current cathode 22 to be inserted into a separate tubular piece 29. Rather in another, not illustrated configuration example, all high-current cathodes 22 can be supported by a common element. To manufacture a grid 1/cathode arrangement 11, the distance to the grid 1-electrode can be ensured by the technician in any desired manner.

However, if the grid 1/cathode arrangement 11 is a solid unit as shown in FIG. 3, it has the advantage that such a unit can be inserted and connected to the grid 1-holder already connected to the other elements of the electron-beam gun system as shown in FIG. 2, without any problems or extensive measurement work. Since the insertion of the grid 1/cathode arrangement 11 into the grid 1-holder 16 can be achieved without large problems outside of the normal systems production, most of the existing production lines are also available for the production of electron-beam gun systems 10 with high-current cathode arrangements 22.

What is claimed is:

1. An electron-beam gun system having at least one cathode arrangement and at least one grid electrode, characterized in that said at least one cathode arrangement is a high-current cathode (22) having an emitting surface (23);

said at least one grid electrode includes a hat-shaped grid 1-electrode (24) located at a distance of 30 to 80 μm from the emitting surface (23) of the high-current cathode (22), which has a width in a range of 30 to 70 μm in a passing area (18.2) for electrons;

said at least one grid electrode includes a grid 2-electrode (15) that is at least 250 μm wide in a passing area (18) for the electrons; and said at least one grid electrode includes a grid 3-electrode (14) having an inlet side that is 250 to 400 μm wide in a passing area (18.1) for the electrons.

2. An electron-beam gun system according to claim 1, characterized in that the diameter of the emitting surface (23) of the high-current cathode (22) is in a range of 0.5 to 1.5 mm.

3. An electron-beam gun system according to claim 2, characterized in that the grid 1-electrode (24) is hat-shaped in the passing area (18.2) of the electrons, and has an area (25) that contains the opening, and a cladding surface (26) that is connected thereto, and forms an angle α in a range of 100° to 170° with the inside of the area, and an edge (27) that is connected to the cladding surface (26) and faces the area (25), and with it forms an angle in a range of 80° to 100°.

4. An electron-beam gun system according to claim 3, characterized in that the passing area (18) of the electrons in the grid 2-electrode (15) is designed as a quadripole.

5. An electron-beam gun system according to claim 4, characterized in that the inlet part (19) of the grid 3-electrode (14) contains apertures (19*a*, 19*b*, 19*c*).

6. An electron-beam gun system according to claim 5, characterized in that each of the apertures (20*a*, 20*b*, 20*c*) of the diaphragm (20) has a diameter in a range of 150 to 400 μm wide, and less than the diameter of the apertures (19*a*, 19*b*, 19*c*) in the inlet part (19) of the grid 3-electrode (14).

* * * * *